United States Patent [19]

Paschal, Jr.

[11] 4,418,750

[45] Dec. 6, 1983

[54] WELL TOOL

[75] Inventor: James H. Paschal, Jr., Dallas, Tex.

[73] Assignee: Otis Engineering Corporation, Dallas, Tex.

[21] Appl. No.: 310,823

[22] Filed: Oct. 13, 1981

[51] Int. Cl.[3] ..... E21B 23/00; E21B 34/14

[52] U.S. Cl. ..... 166/214; 166/322; 166/123; 166/181

[58] Field of Search ..... 166/214, 316–324, 166/332–334, 123–125, 181–182, 386

[56] References Cited

U.S. PATENT DOCUMENTS

| | | | |
|---|---|---|---|
| 3,216,501 | 11/1965 | Page, Jr. | 166/322 X |
| 3,543,847 | 12/1970 | Haeber | 166/208 X |
| 3,642,070 | 2/1972 | Taylor et al. | 166/322 X |
| 4,271,903 | 6/1981 | Slagle, Jr. et al. | 166/322 X |
| 4,294,315 | 10/1981 | Yonker et al. | 166/322 |

OTHER PUBLICATIONS

Otis Engineering Corporation Catalog Nos. 5121-A, pp. 54and 55, and 5121-C, pp. 36 and 37.

*Primary Examiner*—Ernest R. Purser
*Assistant Examiner*—Thuy M. Bui
*Attorney, Agent, or Firm*—H. Mathews Garland

[57] ABSTRACT

A running tool for installing a wireline retrievable safety valve in a landing nipple of a well tubing string including a body connectible with a wireline tool string, a locking assembly for releasably locking the body with a well safety valve, a core connected with the body and connectible by a shear pin with a well safety valve, and a spring isolator tube assembly connected with the core and engageable with a spring operator tube in a safety valve to hold the valve spring compressed during valve installations. The isolator tube assembly prevents down forces on the running tool from direct delivery to the spring operator tube during valve installation.

12 Claims, 5 Drawing Figures

WELL TOOL

Figure 1:
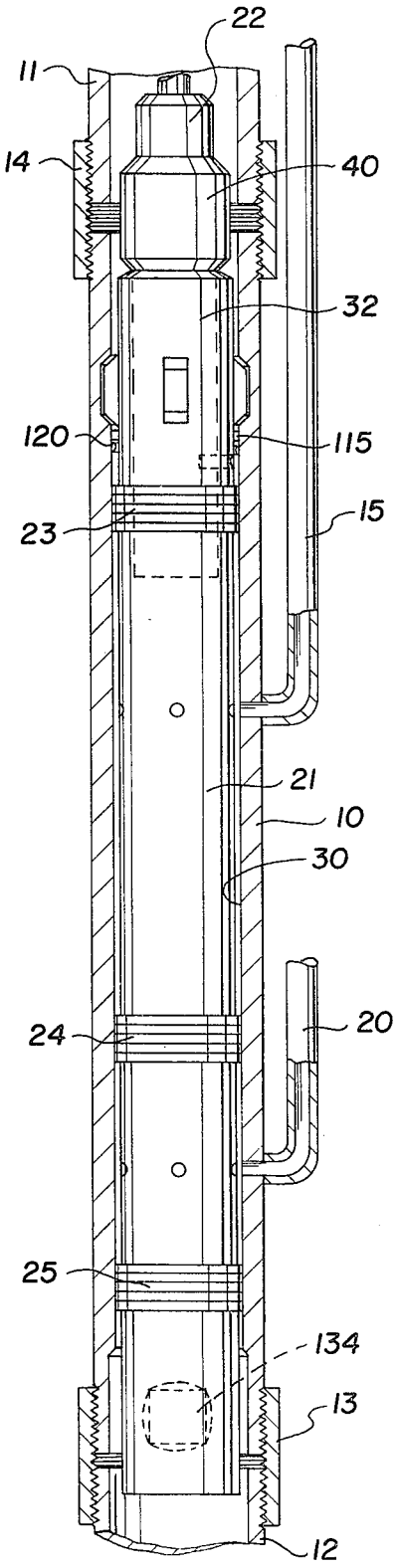

This invention relates to well tools and more particularly relates to a running tool for installation of a well safety valve which is run and retrieved with wireline equipment.

Oil and gas wells frequently are fitted with completion equipment and subsurface safety systems which are installed and retrieved using wireline procedures and handling systems. A variety of flow control apparatus including safety valves are installed in and retrieved from tubular landing nipples using equipment which is supported from a flexible wireline while the equipment is run into a well, installed in a suitable landing nipple, and retrieved from the landing nipple through a tubing string in the well. Running tools which are designed to manipulate the equipment being installed and retrieved are supported from the wireline connected with devices such as jars which are capable of delivering impact blows to the running tools to manipulate the tools such as when setting and retrieving a valve or the like in a landing nipple. Certain of the safety valves handled with wireline equipment include a spring for closing the valve such as when a fluid pressure is released holding the valve open. Such spring presents a problem when installing a safety valve in a landing nipple. Such valves also include external annular packing which tightly engages seal surfaces along a landing nipple for directing control fluid to the proper ports in the valve housing. The annular seals fit sufficiently tightly that substantial driving force is required to insert such valves into a landing nipple. When sufficient shear pins are installed in the running tool to hold the tool in the mode required for inserting the valve into the landing nipple, the pins cannot thereafter be sheared to permit operation of the running tool for actuating the locking mandrel on the valve due to the absorbing of the impact energy by the valve spring. Additionally, a reaction force from the valve spring to the impact blows will tend to shear the pin or pins connecting the running tool with the valve preventing properly locking the valve in the landing nipple and causing release of the running tool from the valve. It has, therefore, been found that proper handling of the safety valve which has such a spring requires temporary isolation of the spring during the landing and locking of the safety valve by the running tool.

It is a principal object of the invention to provide a new and improved running tool for wireline installation of a well safety valve in a landing nipple along a well tubing string.

It is another object of the invention to provide a running tool for a wireline installable well safety valve in which shear pins holding the running tool in an operating mode may be used in sufficient number to hold the running tool in a running-in mode and the pins may thereafter be sheared for locking the safety valve at a landing nipple.

It is another object of the invention to provide a running tool for a wireline installable safety valve wherein a spring in the safety valve will not absorb sufficient impact energy to interfere with proper operation of the running tool.

It is another object of the invention to provide a running tool for a wireline installable well safety valve wherein a spring in the safety valve does not interfere with proper locking of the safety valve locking mandrel and does not cause premature release of the running tool from the safety valve.

It is a still further object of the invention to provide a running tool for a wireline installable well safety valve which permits direct application of impact forces from the running tool to the safety valve housing without absorption of a portion of such forces by a spring in the safety valve.

In accordance with the invention there is provided a running tool for a wireline installable well safety valve which includes a running prong having a first driving shoulder for directly coupling the prong with a safety valve body and a second shoulder engageable with a safety valve operator spring operator tube, the second shoulder being mechanically isolated from the first shoulder for isolating the well valve spring from a driving force applied to the valve body, and means for releasably coupling the running tool with the valve body and a locking mandrel connected with the valve body.

Figure 2:
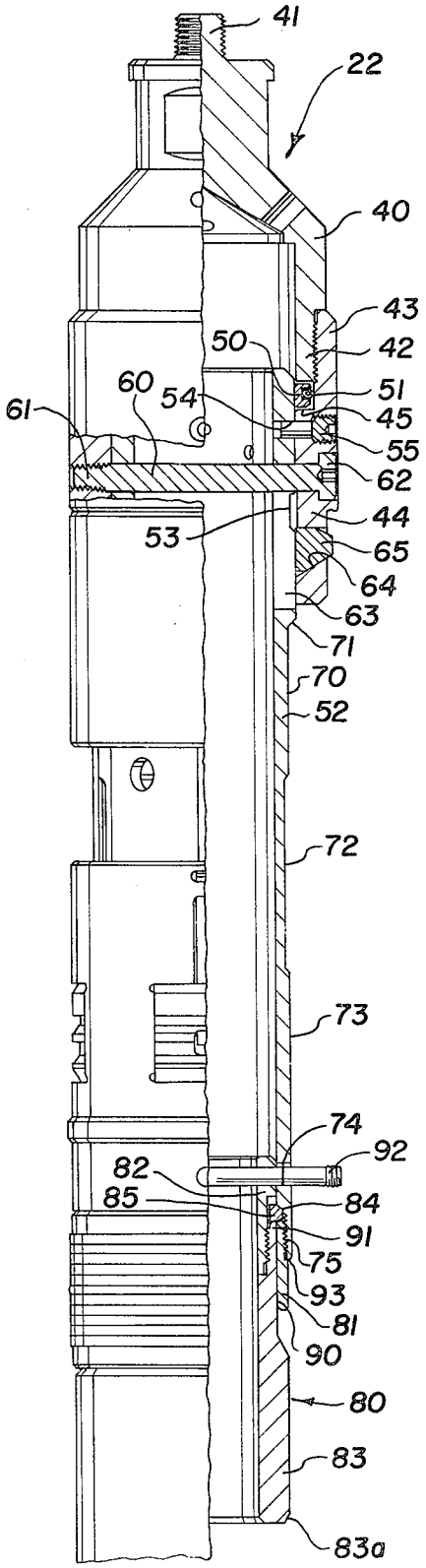
Figure 3A:
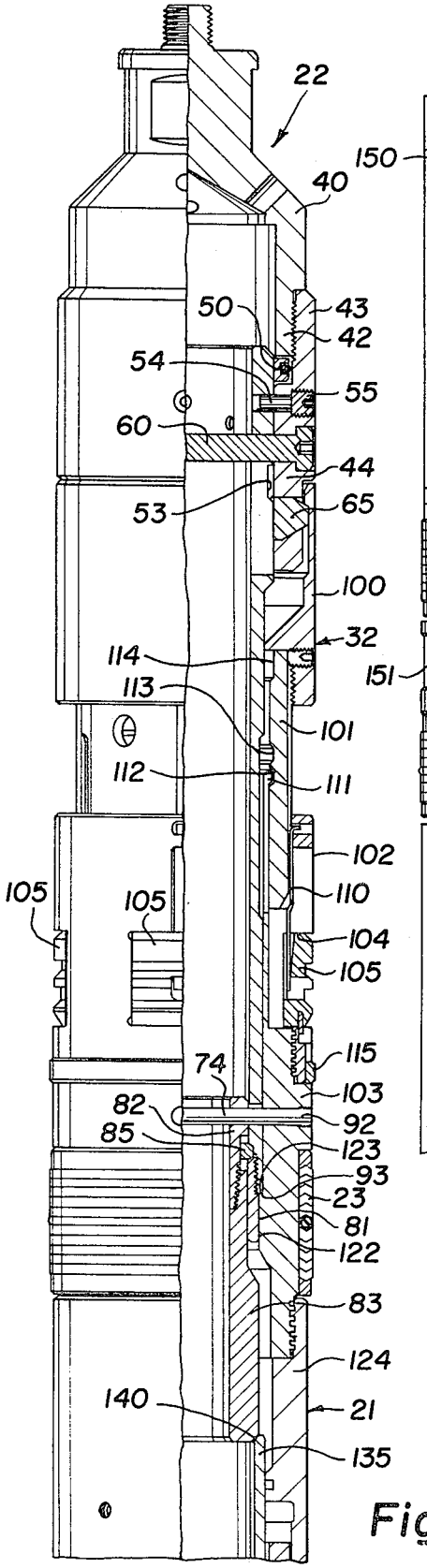
Figure 3B:
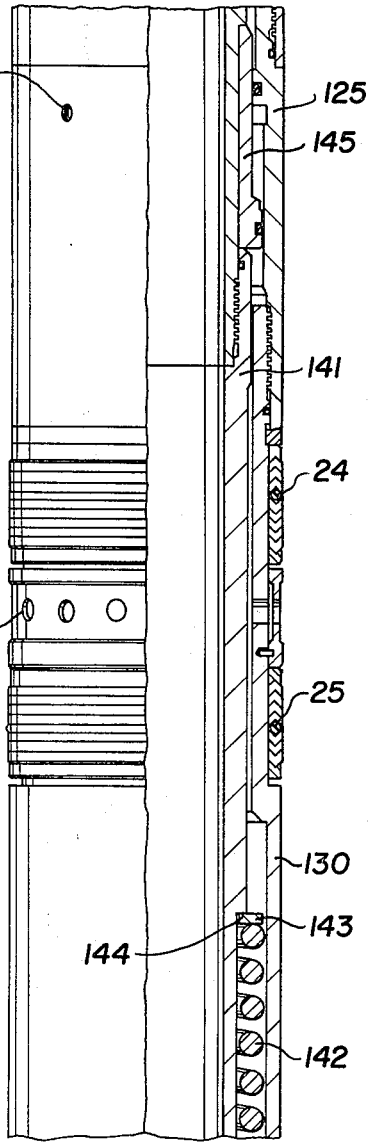
Figure 3C:
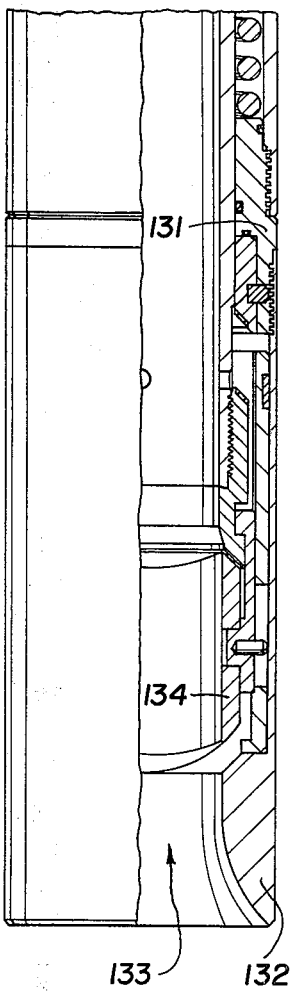

The foregoing objects and advantages of the invention will be better understood from the following detailed description of a preferred embodiment thereof taken in conjunction with the accompanying drawings wherein:

FIG. 1 is a fragmentary schematic view in section and elevation showing the running tool of the invention connected with a well safety valve releasably coupled in a landing nipple along a well tubing string;

FIG. 2 is a fragmentary longitudinal view in elevation and section in which a portion of the safety valve along the running tool is removed showing the essential parts of the running tool only; and FIGS. 3A, 3B, and 3C taken together form a longitudinal view in section and elevation of the running tool of the invention connected with a well safety valve showing the running tool and the safety valve in the running-in mode for lowering the safety valve with the running tool through a well tubing string.

Referring to FIG. 1, a typical well completion system employing a running tool embodying the features of the invention includes a tubing landing nipple 10 connected with tubing sections 11 and 12 by couplings 13 and 14 comprising a portion of a production tubing string within a well bore through which oil and gas flows to a wellhead, not shown, at the surface. Hydraulic fluid control lines 15 and 20 are connected into the landing nipple to supply hydraulic control fluid from the surface to a tubing safety valve 21 which is releasably locked in the landing nipple for shutting off flow along the tubing string in the event of an emergency. The safety valve is lowered through the tubing string and installed in the landing nipple by a running tool 22 incorporating the features of the invention. The safety valve 21 has spaced external annular seal assemblies 23, 24 and 25 which tightly engage the internal seal surface 30 along the bore of the landing nipple 10 for directing hydraulic control fluid from the lines 15 and 20 into the housing of the safety valve. The particular features of the running tool 22 in accordance with the invention permit the running tool to force the tightly fitting annular seal assemblies on the safety valve into the landing nipple when installing the valve in the nipple. The safety valve 21 as illustrated in the drawings is a type DB Otis wireline-retrievable ball-type tubing safety valve manufactured by Otis Engineering Corporation and illustrated and described at pages 54 and 55 of Otis Engineering Corporation Catalog No. OEC-5121-A published in July 1977 entitled "Wireline Completion Equipment and Subsurface Safety Systems." Such catalog also illustrates a typical landing nipple as represented by the schematic illustration of the nipple 10 in FIG. 1. As shown in FIG. 1 the safety valve 21 is connected with a lock mandrel 32 which releasably locks the safety valve in the landing nipple. The lock mandrel 32 as illustrated in the drawings is a type RQ Otis no-go locking mandrel as illustrated and described at pages 36–37 of Otis Engineering Catalog No. OEC-5121-C published in October 1980 entitledd "Wireline Subsurface Flow Control and Related Service Equipment." During installation of the safety valve with the running tool 22, the running tool is connected with suitable conventional wireline equipment including jars, not shown, for lowering the safety valve and lock mandrel along the tubing string into the landing nipple. Available wireline equipment for handling the running tool is illustrated and described in each of the reference catalogs of Otis Engineering Corporation, supra.

In FIG. 2 along the right hand portion of the drawing the upper end of the safety valve 21 and the lock mandrel 32 have been removed to simplify the drawing so that the longitudinal right hand portion of FIG. 2 illustrates only the running tool 22 of the invention. The running tool has a top sub 40 provided with an upwardly extending externally threaded pin 41 for connecting the running tool with a string of wireline tools including jars, not shown, for raising and lowering the running tool and manipulating the running tool within a tubing string. The top sub has a reduced externally threaded lower end portion 42 engaged within an internally threaded upper end portion 43 of a bottom sub 44. The lower end edge of the threaded portion 42 of the top sub 40 and the lower end portion of the enlarged upper bore portion of the top sub define an internal annular recess 45 within the bottom sub. A plurality of lock ring segments 50 are circumferentially positioned within the recess 45 held by a circular garter spring 51. The lock ring segments and garter spring encircle the upper end portion of a core 52 which is telescoped into the bottom and top subs, a major portion of the core extending below the lower end of the bottom sub. The upper end portion of the core forms a sliding fit within the bores of the top and bottom subs so that the core may telescope upwardly into the subs from the lower end position shown in FIG. 2. The upper end portion of the core has an external annular locking recess 53 which receives the lock ring segments 50 for locking the core at an upper end position in the top and bottom subs when the core moves upwardly aligning the recess 53 within the lock ring segments 50 and garter spring 51 which squeezes the lock ring segments radially inwardly into the recess 53. Outer portions of the lock ring segments project into the recess 45 so that the core is locked at the upper end position within the top and bottom subs. The core is releasably secured with the bottom sub by a plurality of shear pins 54 circumferentially spaced around the core and bottom sub extending from the bottom sub into the core in circumferentially spaced holes within the core and bottom sub. A set screw 55 is threaded into the outer portion of each of the shear pin holes in the bottom sub for holding the shear pins 54 in place between the bottom sub and the core. A transverse shoulder bolt 60 extends across the bottom sub intersecting the bore of the bottom sub. The inward end portion 61 of the bolt 60 is threaded into an internally threaded hole along the left side of the bottom sub as seen in FIG. 2. The bolt 60 has a head 62 which fits in countersunk relationship in a graduated hole in the bottom sub aligned with and on the opposite side of the sub from the threaded hole 61 so that the shoulder bolt is held in the transverse relationship shown in FIG. 2. The core has two longitudinal slots 63 aligned with each other along opposite sides of the upper end portion of the core. The shoulder bolt 60 extends through the two longitudinal slots 63 in a loose fitting relationship which permits the core 52 to telescope into the bottom of the top subs for the distance permitted by the length of the slots 63.

The lower end portion of the bottom sub 44 of the running tool 22 has circumferentially spaced windows 64. A locking lug 65 is positioned within each of the windows 64. The windows 64 and the lug 65 are sized and shaped to retain the lugs in the windows so long as the core 52 is within the lugs and to permit the lugs to move radially for releasing and locking the running tool with the head end of the safety valve. The outside diameter of the core 52 below the recess 53 forms a sliding fit within the bottom sub holding the lugs 65 expanded at locking positions as shown in FIG. 2. Below the slots 63 the core 52 has an external reduced release surface 70 which is sufficiently smaller than the bore of the bottom sub 44 to allow the lugs 65 to move radially inwardly to release positions when the core 52 is telescoped into the top and bottom subs to a position at which the release surface 70 is aligned within the lugs 65. A tapered external annular surface 71 on the core lies between the larger diameter of the core which holds the lugs expanded and the reduced release surface 70 of the core. The core 52 has a still further reduced external annular surface 72 below the surface 71 and an enlarged lower end external annular surface 73. The lower end portion of the core 52 has shear pin holes 74. The lower end portion of the core is internally threaded at 75.

In accordance with the particular features of the invention a spring isolator running prong assembly 80 is secured within and extends beyond the lower end of the core 52. The assembly 80 includes a retainer nut 81, a shear pin sub 82, and a spring isolator prong 83. The nut 81 threads a limited distance into the portion 75 of the core so that the upper end edge of the nut 81 and the bore of the core above the upper end edge of the nut define an internal annular recess 84 within the core above the nut in which a retainer ring 85 is disposed for holding the assembly 80 with the core. The prong 83 has a reduced external diameter 90 along the upper end portion of the prong which forms a sliding fit within the bore of the retainer nut 81. The shear pin sleeve 82 screws a limited distance into the upper end portion of the prong 83 and has an external annular flange portion along the upper end of the sleeve so that the outside diameter of the sleeve 82 below the enlarged upper end portion above the upper end edge of the prong 83 defines an external annular recess 91 which is longer than the width of the retainer ring 85. The retainer ring 85 is sufficiently thick that the outer portion of the ring fits in the internal recess 84 between the core 52 and the nut 81 while the inner portion of the ring 85 is within the recess 91 between the prong 83 and the sleeve 82. The external diameter of the upper end portion of the sleeve 82 is sized so that the sleeve 82 slides easily within the core 52. The retainer ring 85 allows the prong 83 and the connected sleeve 82 to move a short distance upwardly and downwardly relative to the core 52. A shear pin 92 is fitted through the sleeve 82 projecting radially outwardly through the shear pin holes 74 in the core 52 beyond the outer surface of the core sufficiently for connecting the running tool with the safety valve 21 as described in more detail hereinafter. The hole 74 in the core 52 is larger in diameter than the shear pin 92 which allows the core 52 and the nut 81 to move a short distance relative to the shear pin 92. Since the prong 83 and the sleeve 82 may move a short distance relative to the retainer ring 85 and the core 52 may move relative to the shear pin 92, the core assembly 80 is effectively mechanically isolated from the core 52 which permits impact blows to be delivered to the safety valve 21 without transmitting the blows directly to the spring of the safety valve as discussed in more detail hereinafter. The lower end portion of the core 52 is larger in diameter than the outside diameter of the retainer nut 81 so that the downwardly and inwardly tapered lower end edge of the core 52 defines an external annular driving shoulder 93 on the running tool core for delivering impact blows to the body of the safety valve 21 when installing the safety valve in a landing nipple.

The structural details of the lock mandrel 32 and the safety valve 21 relevant to the operation of the running tool 31 are illustrated in FIGS. 3A, 3B and 3C which show the running tool connected with the lock mandrel and safety valve for installation of the lock mandrel and safety valve in the landing nipple 10 as illustrated in FIG. 1. Referring to FIG. 3A, the lock mandrel 32 includes a fishing neck 100 secured on the upper end of an expander sleeve 101 which telescopes into a key retainer sleeve 102. The retainer sleeve 102 is secured on a tubular packing mandrel 103. The sleeve 102 has circumferentially spaced windows 104 in each of which is a radially expandible locking key 105. A longitudinal spring 110 fits within the sleeve 102 behind each of the keys 105 biasing each of the keys outwardly toward locking positions. The expander sleeve 101 telescopes within the sleeve 102 behind the keys 105 to lock the keys outwardly. In the position of the sleeve 101 shown in FIG. 3A the lower portion of the sleeve is above the keys 105 so that the keys are free to move inwardly to release positions. Upwardly extending collet fingers 111 are formed on the mandrel 103 extending within the expander sleeve 101 for releasably locking the expander sleeve at one of three positions defined by longitudinally spaced internal annular locking recesses 112, 113, and 114. A no-go ring 115 is mounted on the mandrel 103 around the lower end portion of the sleeve 102 for engagement with a stop shoulder 120 within the landing nipple 10, FIG. 1, for limiting the downward movement of the safety valve 21 and the lock mandrel 32 in the landing nipple. The external annular packing assembly 123 is mounted on the packing mandrel 103 for sealing around the packing mandrel within the landing nipple 10 below the landing nipple stop shoulder 120. The mandrel 103 has a reduced diameter along a portion 122 providing an upwardly facing internal annular tapered stop shoulder 123 which is engageable by the shoulder 93 on the running tool 32 when the running tool is installed in the lock mandrel and safety valve as shown in FIG. 3A.

As shown in FIGS. 3A, 3B and 3C, the safety valve 21 has a housing comprising tubular members 124, 125, 130, 131 and 132. The external annular packing assemblies 24 and 25 are mounted on the housing member 130 as shown in FIG. 3B. A ball valve assembly 133 including a rotatable ball valve member 134 is mounted within the housing sections 131 and 132 for controlling flow through the safety valve. A ball valve operating tube assembly is connected with the ball valve assembly for rotating the ball valve between open and closed positions. The operating tube assembly includes a tube 135, FIG. 3A, having an internal upper end operating shoulder 140. The lower end portion of the tube 135 screws into the upper end portion of an operating tube section 141, FIG. 3B, which connects along a lower end portion, FIG. 3C, into the ball valve assembly 133 so that upward and downward movement of the operating tube assembly rotates the ball valve open and closed. A valve spring 142 between the valve housing and the operating tube assembly is engaged at a lower end with the upper end edge of the housing section 131 and at an upper end with a stop ring 143 engaging a stop shoulder 144 on the valve operating tube 141. An annular hydraulic piston 145 is mounted on the operating tube 135 within the housing section 125 for moving the operating tube assembly to open the ball valve against the spring 142 which is compressed when the ball valve is open. Ports 150 in the housing section 125 communicate hydraulic fluid into the housing above the piston 145 for controlling the opening of the ball valve. Ports 151 in the valve housing communicate balance line hydraulic pressure from the surface to the other side of the piston 145 to overcome the hydrostatic pressure resulting from the depth at which the safety valve is installed. The use of the balance line arrangement permits the spring to close the safety valve when hydraulic control fluid pressure is relieved so that the spring does not have to lift the column of fluid between the safety valve and the surface when closing the valve.

For installation of the safety valve 21 with the lock mandrel 32, the running tool 22 is installed in the lock mandrel and safety valve as illustrated in FIG. 3A. When connecting the running tool with the lock mandrel and safety valve, the bottom mandrel 44 of the running tool is lowered on the core 52 until the lugs 65 are below the shoulder 71 so that the lugs may move radially inwardly to release positions. The safety valve 21 is manipulated to open the ball valve member 134. The running tool core with the prong assembly 80 attached is inserted into the lock mandrel 32 and the ball valve 21 until the shoulder 93 on the core engages the stop shoulder 123 within the packing mandrel 103 of the lock mandrel and the lower end edge **83*a* on the spring isolator prong 83 engages the upper end edge 140 of the ball valve operator tube 135, FIG. 3A. Shear pins 92 are inserted through the packing mandrel 103 into the appropriate holes of the core 52 and the shear pin sleeve 82 of the prong assembly 80 thereby connecting the lower portion of the core and the prong assembly with the mandrel 103 of the lock mandrel 32. The bottom sub 44 of the running tool and the fishing neck 100 of the lock mandrel 32 are manipulated to locate the lugs 65 in the locked position whereby the running tool is coupled with the lock mandrel as shown in FIG. 3A. The shear pins 54 and the set screws 55 are installed between the bottom sub and the upper end portion of the core of the running tool connecting the lock mandrel with the running tool. The coupling of the running tool with the lock mandrel is done with the top sub 40 removed. After properly positioning and shear pinning the bottom sub 43 to the upper end of the core 52 the lock segments 50 and the garter spring 51 are installed between the bottom sub and the upper end portion of the core. The top sub 40 is then threaded into the bottom sub to the position shown in FIG. 3A. Thus the running tool is coupled by means of the lugs 65 with the lock mandrel 32, the shear pins 54 hold the running tool in the running-in condition, and the core 52 of the running tool and the prong assembly 80 connected with the core are shear pinned with the packing mandrel 103 of the lock mandrel. The lower end of the spring isolator tube 83 engages the upper end of the member 135 of the safety valve operating tube assembly holding the spring 142 compressed and the ball valve 134 open. The force of the compressed spring 142 is exerted upwardly through the operating tube assembly members 141 and 135 against the spring isolator tube 83 which is connected with the sleeve 82. The sleeve 82 is connected by shear pins 92 with the packing mandrel 103 of the lock mandrel. Since the shear pin holes 74 of the running tool core 52 are larger than the diameters of the shear pins 92, the force of the compressed spring 142 is applied directly from the sleeve 82 into the packing mandrel 103 with the core 52** mechanically isolated from the force of the compressed spring.

After the running tool 22 is properly connected with the lock mandrel 32 and the safety valve 21, the running tool is secured by the pin 41 with the desired wireline tool string including jars for applying the necessary impact forces to install the safety valve and lock mandrel. The wireline operator lowers the tool string supported safety valve into the tubing spring until a loss of weight is noticed on the weight indicator, not shown, of the wireline rig indicating to the operator that the safety valve is entering the landing nipple 10 with the tight fit of the packing assemblies 24 and 25 hindering the easy entry of the safety valve into the landing nipple. At this time the operator then begins jarring downwardly applying impact forces to the running tool. These forces travel downwardly through the top sub 40 of the running tool, the shear pins 54, the core 52, and the shoulder 93 on the lower end edge of the core into the shoulder 123 of the packing mandrel 103 of the lock mandrel. Since the packing mandrel 103 is threaded directly into the housing member 124 of the safety valve 21 the downward forces of the jarring force the safety valve housing downwardly moving the packing assemblies 23, 24 and 25 along the lock mandrel and safety valve into sealing engagement along the internal seal surface 30 of the landing nipple 10. Because the shear pin holes 74 in the core 52 are larger than the shear pins 92, the downward blows being applied to the safety valve housing are not applied directly to the spring isolator prong 83 which is coupled with the spring 142. Thus as the safety valve is jarred downwardly, the spring 142 is not further compressed and therefore is effectively isolated and does not produce the unsatisfactory reactions encountered with prior art devices. The downward jarring on the core 52 will not shear the pins 92 because of the direct engagement of the core with the shoulder 123 in the packing mandrel 103 of the lock mandrel. The downward jarred continues until downward movement of the safety valve 21 into the landing nipple is limited by the engagement of the no-go ring 115 with the stop shoulder 120 within the landing nipple. Further downward jarring then shears the pins 54 releasing the top sub 40 and bottom sub 44 of the running tool to telescope downwardly on the core 52 from the upper end running-in position shown in FIG. 3A. The downward movement of the top and bottom subs of the running tool on the core drives the fishing neck 100 and the expander sleeve 101 of the lock mandrel downwardly behind the keys 105 expanding and locking the keys in the locking recess of the landing nipple. The collet fingers 111 spring inwardly within the sleeve 101 expanding back outwardly when the internal locking recess 114 in the sleeve 101 is aligned with the heads of the collets 111. The downward movement of the top and bottom subs carries the lugs 65 downwardly below the shoulder 71 where the lugs may move inwardly around the core 52 along the surface 70 releasing the lugs 65 from the fishing neck 100 of the lock mandrel 32. The lock segments 50 held by the garter spring 51 move inwardly into the locking recess 53 on the core 52. It will be apparent that with the downward movement of the top and bottom subs of the running tool, the shoulder pin 60 is carried downwardly along the longitudinal recesses 63 of the core 52. Of course the downward jarring necessary to release the pins 54 and fully engage the keys 105 of the lock mandrel 32 does not shear the pin 92 because the downward motion of the various members of the running tool and lock mandrel moving downwardly telescope along the core 52 which cannot move downwardly due to the engagement of the shoulder 93 along the core with the internal shoulder 123 in the packing mandrel 103 of the lock mandrel.

After the wireline operator has determined that the lock mandrel 32 is locked in the nipple 10, a quick upward jar is applied to the tool string. Since the lock segments 50 have engaged the locking recess 53 after the downward telescoping movement of the upper and lower subs 40 and 44, the upward jar to the running tool applies an upward force through the lock segments 50 to the core 52. The upward force on the core 52 shears the pin 92 releasing the core from the packing mandrel 103 and releasing the shear pin sleeve 82 of the spring isolator assembly 83. Since the lugs 65 are at inward release positions the upward jar does not tend to release the lock mandrel 32. The tool string is then lifted upwardly pulling the running tool from the lock mandrel and the safety valve. As the core 52 of the running tool is lifted upwardly, the coupling of the spring isolator tube assembly 80 with the lower end portion of the core 52 by the ring 85 lifts the assembly 80 with the core so that the assembly is pulled from the safety valve as the running tool is lifted. The isolator tube 83 is thus disengaged from the upper end of the safety valve spring operator tube assembly so that the spring 142 is free to expand to close the safety valve. The safety valve may thereafter be operated by hydraulic fluid communicated to the valve through the tubes 15 and 20 leading from the surface to the landing nipple 10.

It will now be understood that the principal feature of the new and improved running tool of the invention is the isolation of the safety valve spring from the downward impact forces used in driving the safety valve into the landing nipple and setting the lock mandrel on the safety valve to lock the valve in the nipple. The isolation of the safety valve spring prevents the absorption of substantial energy from the downward forces which has in previous equipment interfered with proper landing and locking of the safety valve. Thde downward forces are thus transmitted directly into the packing section along the safety valve and lock mandrel. By removing the safety valve spring as a factor, premature release of the running tool and interference with proper locking of the lock mandrel are no longer a problem.

What is claimed is:

1. A running tool for installing a spring operated safety valve in a landing nipple of a well tubing string comprising: a body having means for connection with a handling tool string and means for connection with a lock mandrel connected with said safety valve; a core connected with said body and connectible with said lock mandrel for applying forces to drive said lock mandrel and safety valve into said landing nipple; and a spring isolator tube assembly connected with said core and engageable with a spring operator tube of said safety valve to compress the spring of said valve and isolate said tube from said forces directed toward said mandrel and safety valve.

2. A running tool for installation of a spring operated safety valve in a well tubing string comprising: tool body means having means for connection at a first end with an operating tool string for supporting said running tool in said tubing string and manipulating said running tool for inserting said safety valve into and locking said valve with a landing nipple; locking means on said body means for releasably coupling said body means with said safety valve; a core connected along a first end with said body means and extending from a second opposite end of said body means for telescopically engaging a body mandrel of said safety valve; first internal shoulder means associated with said safety valve; second external shoulder means on said core engageable with said first shoulder means for applying a downward force from said core into said first shoulder means to drive said safety valve into said landing nipple; and safety valve spring isolator means coupled with said core for compressing a valve operating spring in said safety valve while isolating said spring from downward impact forces applied to said core.

3. A running tool in accordance with claim 2 where said spring isolator means is slidably coupled with said second end portion of said core.

4. A running tool in accordance with claim 3 where said spring isolator means is connected with the housing of said safety valve and said core is adapted for limited longitudinal movement relative to said spring isolator means.

5. A running tool in accordance with claim 4 including a shear pin between said spring isolator means and said safety valve and said core is free to move downwardly relative to said shear pin.

6. A running tool in accordance with claim 5 where said spring isolator means telescopes at one end into said second end portion of said core, said shear pin extends from said spring isolator means through an opening in said core into mandrel means connected with said safety valve housing, and said opening in said core is larger than said shear pin.

7. A running tool in accordance with claim 6 including a locking ring between said spring isolator means and said core whereby said spring isolator means is longitudinally movable relative to said core and said spring isolator means is retrieved from said safety valve when said core is withdrawn from said safety valve.

8. A running tool in accordance with claim 7 where said spring isolator means comprises a tubular assembly having an external annular end shoulder surface engageable with an end shoulder surface on a spring operator tube in said safety valve for holding said tube at a position at which the spring of said safety valve is compressed when said spring isolator means is connected by said shear pin with said safety valve housing.

9. A running tool in accordance with claim 8 including radially movable locking lugs on said body means for releasably coupling said body means with a fishing neck connected with said safety valve and said core is releasably secured with said body means by shear pins adapted to release for movement of said body means relative to said core means to operate a lock mandrel connected with said safety valve and release said running tool from said safety valve.

10. A running tool in accordance with claim 9 where said shear pins between said core and said body means are sheared responsive to a downward force on said body means for inserting said safety valve into said landing nipple and locking said safety valve in said nipple and said shear pin between said spring isolator means and said safety valve is sheared responsive to an upward force on said body means for releasing said running tool from said safety valve.

11. A running tool for installation of a wireline retrievable safety valve in a landing nipple along a well tubing string comprising: a tubular top sub having end means for connection with a wireline operating tool string; a tubular bottom sub connected with said top sub along one end portion and having circumferentially spaced windows along an opposite end portion; locking lugs in said windows of said bottom sub for radial movement between lock and release positions for releasably coupling said running tool with a fishing neck on a lock mandrel connected with said safety valve; a tubular core telescopically engaged along a first end portion in said top and bottom subs, said core having longitudinal slots along opposite sides thereof and an external annular locking recess along said slots; a transverse shoulder pin secured across said bottom sub through said longitudinal slots of said core to permit said core to move longitudinally relative to said top and bottom subs; radially movable lock segments within said top and bottom subs around said first end portion of said core for engagement with said locking recess on said core to releasably lock said core with said subs when releasing said running tool from said fishing neck; shear pin means between said core and said bottom sub for releasably connecting said core with said bottom sub at a running-in condition of said tool and releasing said subs from said core for operating said lock mandrel connected with said safety valve; a spring isolator tube assembly slidably telescoped along a first end portion into said second end portion of said core, said spring isolator tube assembly being coupled with said core for limited longitudinal movement relative to said core and having an annular shoulder along a second end of said assembly for engaging a spring operating tube in said safety valve to compress said spring and isolate said spring from downward impact forces applied to said core through said subs; shoulder means on said core engageable with shoulder means in the packing mandrel of said lock mandrel connected with said safety valve; means for connecting a shear pin between said spring isolator tube assembly and said packing mandrel of said lock mandrel through said core; and opening means in said core for said shear pin extending into said spring isolator tube assembly, said opening means being larger than said shear pin to permit limited downward movement of said core relative to said spring isolator tube assembly for isolating said assembly from downward forces on said core.

12. A running tool in accordance with claim 11 where said spring isolator tube assembly includes a shear pin sleeve slidably engaged in said second end portion of said core and having a shear pin hole for said shear pin between said assembly and said packing mandrel; a spring isolator tube connected with said shear pin sleeve slidable along a first end portion in said second end portion of said core; an external annular recess defined around said shear pin sleeve between a shoulder on said sleeve and an end edge of said spring isolator tube; an external retainer ring in said recess secured with said core, said retainer ring having a width less than the length of said recess to permit limited movement of said spring isolator tube assembly relative to said core; and a retainer nut in said second end portion of said core engaging said retainer ring for coupling said spring isolator tube assembly with said second end portion of said core.

* * * * *